United States Patent [19]

Balland

[11] 3,988,111

[45] Oct. 26, 1976

[54] PROCESS FOR THE DYEING OF TEXTILE FIBERS IN AN ORGANIC-SYSTEM MEDIUM

[75] Inventor: Jean Balland, Chateaurenault, France

[73] Assignee: Manufacture de Produits Chimiques Protex, Paris, France

[22] Filed: Mar. 17, 1975

[21] Appl. No.: 559,151

[30] Foreign Application Priority Data

Mar. 18, 1974 France ..... 74.09037

[52] U.S. Cl. ..... 8/172 R; 8/30; 8/54.2; 8/80

[51] Int. Cl.[2] ..... D06P 5/06

[58] Field of Search ..... 8/84, 54.2, 30, 172

[56] References Cited

UNITED STATES PATENTS 3,853,460 12/1974 Balland ..... 8/84

FOREIGN PATENTS OR APPLICATIONS 1,589,218 4/1970 France

*Primary Examiner*—Joseph L. Schofer
*Assistant Examiner*—A. L. Clingman
*Attorney, Agent, or Firm*—Karl F. Ross; Herbert Dubno

[57] ABSTRACT

Process for dyeing of cellulosic textile fibers which comprises treating the cellulosic fibers with the dye in a bath consisting at least in major part of an organic solvent and in the presence of a quaternary ammonium compound of the formula

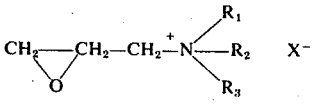

wherein $R_1$, $R_2$ and $R_3$ are the same or different and are each $C_1$ to $C_3$ alkyl and $X^-$ is an anion selected from the group which consists of the halogenides, sulphate, nitrate or the like. The quaternary ammonium salt can be added to the dyeing bath or can be used to treat the fibers in a dye-free bath prior to the dyeing step.

10 Claims, No Drawings

PROCESS FOR THE DYEING OF TEXTILE FIBERS IN AN ORGANIC-SYSTEM MEDIUM

FIELD OF THE INVENTION

The present invention relates to the dyeing of textile fibers in a dyeing bath consisting of at least in major part organic medium or solvent (as opposed to a predominantly aqueous medium) and, more particularly, to a process for the printing and dyeing of cellulosic fibers in which the normally aqueous dye or printing liquor has its aqueous medium replaced in whole or at least in major part by an organic solvent.

BACKGROUND OF THE INVENTION

It has been recognized for several years, especially for the purpose of eliminating pollution of water by industrial wastes, that the large quantity of water used in the dyeing of textile materials can be economically replaced by a much more limited quantity of organic solvent or a medium consisting in major part of an organic solvent and in minor part of water. The use of this dye process—termed "solvent dyeing"—, as contrasted with dyeing in a totally aqueous medium, has encountered a number of difficulties, especially for cellulosic fibers and with dyes which have commonly been used therefor.

It has been found in practice that the poor penetration of the fibers (from the surface to the interior) or fabric by the dyestuff produces an irregular or mottled effect, i.e. the fabric is marked with small points of less dense or more dense coloration.

Because of the generally poor solubility of the dyestuff in most of the organic solvents capable of being used in the dyeing process, the dyeing bath is exhausted to only a limited degree and leaves the treating apparatus, at the end of the operation, containing significant quantities of the dyestuff. As a result the process for recovering the solvent to enable its recycling for subsequent dyeing operations and its purification is long, costly and difficult.

OBJECTS OF THE INVENTION

It is the object of the present invention to overcome these difficulties and provide an improved process for the dyeing of textile fibers, especially cellulosic fibers, using dyestuffs which have been found to be applicable for use in aqueous media, but without the disadvantages of aqueous-system dyeing and also free from the disadvantages of prior-art solvent-dyeing techniques using organic solvent media.

A collateral object of the invention is to permit the dyeing of cellulosic fibers in an organic-solvent medium which allows total recovery of the solvent at low cost and with considerable efficiency.

DESCRIPTION OF THE INVENTION

The invention is based upon my discovery that the dyeing of cellulosic fibers can be effected with substantially total exhaustion of the dyestuff from the dyeing bath when the treatment is carried out in the presence of a specific quaternary ammonium compound which can be introduced into the dyeing bath or previously applied to the textile fiber or fabric from another bath, provided that the dyeing bath consists predominantly of an organic solvent (i.e. is an organic solvent entirely or consists at least in major part of an organic solvent in combination with a minor part of water) and further that the bath from which the quaternary ammonium salt is applied likewise contains organic solvent. It is the combination of the particular class of quaternary ammonium salt and the solvent dyeing process for cellulosic fibers which has been found to be critical.

In practice, this combination results in improved penetration of the dyestuff and diffusion thereof into the fibrous substrate, total exhaustion of the dyestuff from the essentially organic bath, and simpler purification of the solvent (if even necessary) as a result of the more complete removal of dyestuff therefrom.

The term "dyeing" as used herein is intended to include batch dyeing in which the fabric or fibers are immersed in the bath, print dyeing or printing in which the fibers or fabric is subjected to treatment with the dyestuff to form patterns, and other textile coloring techniques well known in the art.

More specifically, the invention consists in introducing into the printing bath before dyeing or into the dyeing bath itself a quaternary ammonium compound of the formula

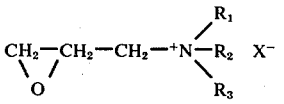

in which $R_1$, $R_2$ and $R_3$ are the same or different and are alkyl groups having 1 to 3 carbon atoms. $X^-$ is an anion selected from the group which consists of halogenide (fluoride, chloride, bromide, iodide), sulfate, nitrate or the like.

In prior work, as for example the commonly owned French Pat. No. 1,589,218 of 25 Sept. 1968, it has been especially noted that quaternary ammonium derivatives of the epoxy-2,3-propyl-N(trialkyl)-ammoniumchloride and especially the epoxy-2,3-propyl-N-trimethylammoniumchloride can be used as additives to printing pastes and dyeing baths for various types of textiles including cellulosic fibers. In all cases, however, the systems were aqueous in nature and it has hitherto been believed that the quaternary ammonium compound interacts between the water of the medium and the dyestuff to provide more uniform dyeing. The systems used reactive dyestuffs, direct dyestuffs, solvent-containing dyestuffs, vat dyes and the like. The quaternary ammonium compounds appear to play a role in ionic interaction between the cellulosic fibers and the dyestuff.

As far as I am aware no one has hitherto conceived that a quaternary ammonium compound of the aforedescribed type can in any way improve the interaction of a dye in a medium consisting entirely or in major part of an organic solvent. It is thus a surprising discovery that, when this ionic additive is applied in the context of a nonpolar system, such as one using an organic solvent at least in major part, it is possible to overcome disadvantages which appear to be inherent in solvent dyeing of cellulosic fibers from organic media.

The surprising effects encompass a number of aspects. For example, the intensity of the coloration of the textile for a given dyestuff is markedly increased when the particular quaternary ammonium salts are used, the penetration of the dyestuff into fiber is substantially complete and is far greater than is obtainable without the additives, the dyestuff can be completely exhausted from the bath and the retention of dyestuff by the fiber, even under subsequent treatment, is vastly improved.

The additive must be present in the fiber at the time it is contacted with the dyestuff and thus it is possible to print the fabric with the additive prior to dyeing and then introduce the fabric into a bath of the dyestuff, the dye being preferentially deposited in the regions which were treated with the quaternary ammonium compound. In that case, the treatment bath containing the quaternary ammonium compound is devoid of a dyestuff. Of course, the fabric or fibers can be treated without printing in bulk in a bath containing the quaternary ammonium compound and free from the dyestuff and then can be introduced into a bath containing the dye. Alternatively, the quaternary ammonium compound is introduced directly into the dye bath.

The organic solvent medium may be drawn from one of two classes, namely, hydrophobic solvents and hydrophilic solvents.

The hydrophobic solvents which may be used according to the invention are nonmiscible with water and include aromatic or cycloaliphatic alcohols such as benzylic alcohol and cyclohexanol; esters such as ethylacetate and propylacetate; hydrocarbons such as benzene and xylene; and halogenated hydrocarbons such as chloroform, trichloroethane, trichloroethylene and perchloroethylene.

The hydrophilic solvents, miscible with water, which may be used according to the invention include aliphatic alcohols such as ethanol and isopropanol; ketones, acetals and ethers such as diisopropylether, oxygen-containing heterocyclic compounds such as dioxane, glycol derivatives; and aprotic polar solvents such as dimethylsulfoxide and dimethylformamide.

The dyestuffs which may be used in the practice of the present invention may be drawn from the various classes of cellulosic-fiber dyes well known in the art, including the direct dyes, sulfur-base dyes, vat dyes and acid dyes.

Since the quaternary ammonium compounds of the aforedescribed type are only slightly soluble in said hydrophobic solvents, it is advantageous, when working with such solvents, to introduce into the system a third solvent which is a hydrophilic solvent as defined above and possibly a small quantity of water. The water can be introduced in the latter case, with the aid of an emulsifying agent.

As emulsifying agents I am able to use substantially all of the compounds known for this purpose (see Schwartz & Perry, *SURFACE-ACTIVE AGENTS*, VOL. 1, Interscience Publishers 1949, pages 338 ff, and the specific surface-active agents of the several classes enumerated here). Best results are obtained with ethers or amines of polyhydroxyl compounds, alkylphenyl or naphthyl polyoxyalkyls; the alkylene polyesters of fatty acids, polyoxyalkyl carbamates and polyoxyalkyl sulfamates.

In practice, the process of the present invention can be carried out in accordance with either of two variants.

In a first variant, the quaternary ammonium compound described above is used in a treatment bath prior to dyeing which contains only the quaternary ammonium additive dissolved in one or more organic solvents in the complete action of water. After the fabric has been immersed in this bath, generally for a period of 15 to 60 minutes at a temperature of 35° to 70° C, the cellulosic fibers are introduced into the actual dye bath containing the dye and the two other conventional constituents of such dyeing baths, the dyeing bath having as the vehicle one or more pure organic solvents which may be identical to or different from the solvent of the treatment bath. The dyeing vehicle may, alternatively, consist in major part of hydrophobic solvent and may contain a small quantity of water and sufficient emulsifying agents to emulsify the water into the continuous phase constituted by the hydrophobic solvent. The water may be present in an amount of 0.5 to 2 parts by weight per 10 parts by weight of the solvent.

According to the second variant, the treatment bath prior to dyeing and free from the dyestuff, can include in addition to the organic solvent, a small quantity of water and an emulsifying agent as in the dyeing bath described above. In this case, the dyestuff and the other components of the dyeing bath may be present in a purely organic medium with or without an emulsifying system. In other words either the prior treatment bath containing the quaternary ammonium salt or the dyeing bath may have a totally organic-solvent composition, or may consist in major part of the organic solvent and in minor part of water and an emulsifying system, or each bath may have a completely organic vehicle while the other bath contains the stated small quantity of water and emulsifying system.

In another alternative technique for carrying out the invention, the textile material is introduced directly, i.e. without prior treatment as described above, into a dyeing bath containing the dyestuff and the quaternary ammonium salt of the formula set forth above. The medium or vehicle of the bath can be constituted by one or more organic solvents (i.e. water free), for example a hydrophilic solvent, or a mixture of hydrophobic solvent and a hydrophilic solvent, or the bath may contain an emulsifying system and a small quantity of water in addition to one or more organic solvents as previously described.

The quaternary ammonium salt, regardless of the technique used, should be employed in an amount ranging from 2 to 20% by weight of the fibers treated, preferably between 5 and 10% by weight of the fibers treated.

The process of the present invention is carried out preferably in the dyeing of natural or synthetic cellulosic fibers mixed with other natural or synthetic fibers. The dyeing, surprisingly, can be carried out at relatively low temperatures, for example 35° to 50° C (as compared with temperatures of 80° to 100° C when the quaternary ammonium salts are not used), with a considerable saving in energy. The fibers may be treated as rovings, thread, sheets, felts, fabrics, hanks, knits and the like.

As in all dyeing operations using an organic solvent, the solvent retained by the textile material after treatment is eliminated by one or more conventional techniques such as: evaporation in hot air, entrainment in water vapor, etc. Since the dyestuff is totally exhausted from the solvent after it has been used for the dyeing of textile material, the solvent may be reused without prior purification or the solvent may be used elsewhere.

The following examples are illustrative of how the invention may be carried out in practice. Percentages of the substance used are given in weight percent of the textile material to be treated. In all of the examples the fabric is a cotton sheet and, where the quaternary ammonium derivative is identified below as CEPTA, it is intended to so designate the epoxy-2,3-propyl-N-trimethylammoniumchloride.

SPECIFIC EXAMPLES

EXAMPLE 1

The fabric is treated for 60 minutes in a temperature of 60° C in a solution having the following composition:

10% CEPTA
100 ml ethanol
900 ml perchloroethylene.

The fabric is then drained and is introduced into a dye bath constituted by:

0.5% Blue Direct Dye (Color Index 78)
50 ml dimethylformamide
950 ml perchloroethylene.

The liquor ratio (weight of fabric to volume of bath) was about 1:20 and the dyeing operation was carried out at 95° C for about 30 minutes.

After draining, residual solvent was eliminated by rinsing with water and the fabric was dried. The fabric was characterized by an intense coloration, excellent penetration of the dyestuff, good uniformity and a total extraction of the dye from the bath so that the bath could be used again without purification, for a subsequent dyeing treatment. In addition the color of the fabric withstood conventional subsequent treatment in a humid atmosphere. Similar results were obtained with dye bath temperatures from about 40° C to about 95° C.

EXAMPLE 1A

When the results of Example 1 were compared with the results obtained using the foregoing parameters but omitting the CEPTA, the product was found to be mediocre. There was incomplete removal of dye from the bath, poor penetration and very poor uniformity of coloration. The fabric was incapable of standing up to tests in humid atmosphere.

In another series of tests the organic solvents were replaced by water and results were obtained which were, on the average, better than those obtained with the solvent without CEPTA but significantly poorer than the results obtained using solvent dyeing with CEPTA as set forth. In effect, the intensity of coloration was as great, removal of dyestuff from the bath was not complete and the fabric did not test as well in humid atmosphere.

EXAMPLE 2

Results as excellent as those obtained in Example 1 were noted when ethanol and perchloroethylene were replaced in the prior treatment bath by a mixture of 100 ml of dimethylformamide and 900 ml of perchloroethylene, i.e. the same pair of solvents used in the dyeing bath.

EXAMPLE 3

The fabric is treated for 10 minutes at a temperature of 60° C with a bath identical to the bath described in Example 1 (containing 10% CEPTA). Dyeing is carried out in a bath containing a major proportion of organic solvent and a minor proportion of water and emulsifying agents. The dye bath composition is:

0.5% of Blue Direct 78 Dye
100 ml water
20 g emulsifying agent
900 ml perchloroethylene.

The emulsifying agent is the phosphorous acid ester of polyoxyethylene marketed under the name PHOSPHAC D 10 NK. The liquor ratio (weight of fabric to volume of bath) was 1:20. The temperature was 80° C and the duration was 30 minutes.

The solvent was removed by centrifugal extraction and the fabric was rinsed with water and dried. The fabric had the same characteristics as resulted in Example 1 from the treatment in accordance with the invention.

EXAMPLE 4

The fabric is treated for 30 minutes at a temperature of 90° C in a solution of the following composition:

10% CEPTA
100 ml water
20 g of the emulsifying agent of Example 3
5 g sodium hydroxide
900 ml of perchloroethylene.

The liquor ratio was 1:20.

Thereafter 5% by weight of the fabric of Blue Direct 78 Dye is added to the same bath and the fabric is dyed for an additional 30 minutes at 90° C.

After elimination of the solvent, rinsing with water and drying, the fabric is found to have the same characteristics as resulted from the treatment according to the invention in Example 1, i.e. high intensity coloration, excellent penetration of the dyestuff into the fibers and excellent stability of the dye fabric to humidity tests. The bath was totally depleted of the dyestuff at the end of the treatment.

EXAMPLE 5

The fabric is dyed directly (without pretreatment) in a dye bath consisting of:

10% CEPTA
50 ml of dimethylformamide
950 ml of perchloroethylene
0.5% of Blue Direct 78 Dye.

The liquor ratio was 1:20, the temperature 95% and the duration of treatment 30 minutes. The dyed fabric had the excellent properties previously described with respect to the treatment of the invention in Example 1.

I claim:

1. A process for dyeing cellulosic fiber, comprising the step of:

treating the fiber with a dye-containing bath having a liquid vehicle consisting predominantly of an organic solvent in the presence of a quaternary ammonium compound having the formula

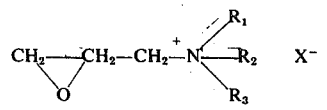

wherein $R_1$, $R_2$, and $R_3$ are identical or different and are alkyl groups having 1 to 3 carbon atoms and $X^-$ is an anion for the quaternary ammonium compound.

2. The process defined in claim 1 wherein said anion is selected from the group which consists of halogenide, sulfate and nitrate anions.

3. The process defined in claim 1 wherein said quaternary ammonium compound is dissolved in said bath and is applied to said fibers simultaneously with the dye.

4. The process defined in claim 3 wherein said vehicle consists entirely of organic solvents.

5. The process defined in claim 3 wherein said vehicle consists predominantly of organic solvent and contains a minor proportion of water and an emulsifying agent.

6. The process defined in claim 1 wherein said quaternary ammonium compound is applied to said fiber prior to the treatment thereof with the dye bath from a treatment bath consisting predominantly of an organic solvent.

7. The process defined in claim 6 wherein one of said baths consists predominantly of an organic solvent and contains a minor proportion of water and an emulsifying agent.

8. The process defined in claim 7 wherein said vehicle contains 0.5 to 2 parts by weight of water per 10 parts by weight of solvent.

9. The process defined in claim 6 wherein the vehicle of at least one of said baths consists entirely of organic solvent.

10. The process defined in claim 1 wherein said quaternary ammonium compound is used in an amount of 1 to 20% by weight of the fibers.

* * * * *